US006766123B2

(12) United States Patent
Ebihara et al.

(10) Patent No.: US 6,766,123 B2
(45) Date of Patent: Jul. 20, 2004

(54) IMAGE FORMING APPARATUS WITH DETECTED-CURRENT TRANSFER MATERIAL CHARGING VOLTAGE CONTROL FEATURE

(75) Inventors: Shunichi Ebihara, Shizuoka (JP); Yoshiro Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 09/986,300

(22) Filed: Nov. 8, 2001

(65) Prior Publication Data

US 2002/0057933 A1 May 16, 2002

(30) Foreign Application Priority Data

Nov. 10, 2000 (JP) ..... 2000-344143
Nov. 10, 2000 (JP) ..... 2000-344157

(51) Int. Cl.[7] ..... G03G 15/01; G03G 15/16
(52) U.S. Cl. ..... 399/66; 399/303
(58) Field of Search ..... 399/66, 303

(56) References Cited

U.S. PATENT DOCUMENTS 5,287,144 A * 2/1994 Takeda ..... 399/66
5,291,253 A * 3/1994 Kumasaka et al. ..... 399/66
5,300,984 A * 4/1994 Fuma et al. ..... 399/66
6,021,286 A 2/2000 Kawai et al. ..... 399/45
6,134,415 A * 10/2000 Iwakura et al. ..... 399/303 X
6,477,339 B1 * 11/2002 Yano et al. ..... 399/66

FOREIGN PATENT DOCUMENTS

| | | |
|---|---|---|
| JP | 6-27837 | 2/1994 |
| JP | 6-35337 | 2/1994 |
| JP | 11-161035 | 6/1999 |

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes a detected-current-controlled voltage charging device for charging a transfer material before a toner image is transferred to the transfer material by a transfer device. A current is produced when a voltage is applied to the charger device before the toner image is transferred. The voltage applied to the transferring device when the image-formed portion of the transferring material passes a transferring part is controlled on the basis of a current produced by a predetermined voltage applied to the transfer device when a leading edge portion of the transferring material passes the transferring part, and the predetermined voltage is controlled on the basis of the output from the current detector.

34 Claims, 8 Drawing Sheets

IMAGE FORMING APPARATUS WITH DETECTED-CURRENT TRANSFER MATERIAL CHARGING VOLTAGE CONTROL FEATURE

BACKGROUND OF THE INVENTION

1. Field of the Invention

This invention relates to an image forming apparatus utilizing the electrophotographic process or the like, and particularly to an apparatus for charging a recording material before transfer.

2. Description of the Related Art

Various processes such as the electrophotographic process, the heat transfer process and the ink jet process have heretofore been adopted in image forming apparatuses. Of these, an image forming apparatus using the electrophotographic process has advantages in high speed, high quality of image and quietude.

FIG. 3 of the accompanying drawings schematically shows the construction of an example of the image forming part of a conventional image forming apparatus using the electrophotographic process.

The image forming apparatus of the electrophotographic type has, for example, a drum-shaped electrophotographic photosensitive body, i.e., a photosensitive drum 1, as an image bearing body, and uniformly charges the surface of the rotating photosensitive drum 1 by primary charging means 2, and thereafter effects exposure 12 in accordance with image information by exposing means 11 such as an LED or a laser to thereby form an electrostatic latent image on the surface of the photosensitive drum 1. Thereafter, the electrostatic latent image is developed by a developing apparatus 8 by the use of a developer (a toner, or a toner with a carrier), and the toner is made to electrostatically adhere to the latent image, which is thus visualized as a toner image.

In synchronism with the formation of the toner image on such a photosensitive drum 1, a transferring material P is conveyed from a sheet feeding cassette 15 by conveying means 14, and the toner image on the photosensitive drum 1 is electrostatically transferred onto the transferring material P conveyed to a transferring position opposed to the photosensitive drum 1 by the conveying means 14, by the action of transfer charging means 4. Thereafter, the toner image transferred onto the transferring material P is fixed by being heated and pressurized by a fixing apparatus 21, whereby a permanent image is obtained on the transferring material P.

On the other hand, any untransferred toner residual on the photosensitive drum 1 after transfer is removed by a cleaning blade provided in a drum cleaner 10, and is collected into the container portion (waste toner container part) of the cleaner 10. The photosensitive drum 1 having had its surface thus cleaned is repetitively used for image formation.

Now, in recent years, color image forming apparatuses using the electrophotographic process have spread. There are various types of color image forming apparatuses. Besides the well-known multiple transfer type and intermediate transferring member type, there are the multiple developing type in which development is repeated on the surface of an image bearing body to thereby superimpose and form toner images of plural colors, whereafter the toner images are collectively transferred, and the in-line type which has image forming means (process stations) of a plurality of different colors along a transferring material conveying belt and toner images of the plural colors are superimposed and transferred to a transferring material conveyed by the conveying belt.

The color image forming apparatus of the in-line type can be made higher in speed and has many advantages including the advantage in quality of image due to the low frequency of toner image transfer. In this in-line type, there has also been proposed a construction in which for the improvement in usability and the reduction in installation area, the process stations are arranged in a vertical direction and a transferring material is conveyed substantially vertically.

FIG. 4 of the accompanying drawings shows an example of the construction of a full color image forming apparatus of the conventional in-line type. This apparatus has an electrostatic sucking belt, i.e., a conveying belt 14, as a transferring material conveying member, and the conveying belt 14 is passed over a drive roller 23, a sucking opposed roller 22 and tension rollers 13*a*, 13*b*. The conveying belt 14 is rotatively driven in the direction of arrow by the drive roller 23.

Process stations 31Y, 31M, 31C and 31Bk which are yellow (Y) magenta (M), cyan (C) and black (Bk) image forming parts are disposed along the peripheral surface of the conveying belt 14, and a transferring material is sequentially conveyed to the respective process stations by the conveying belt 14. Each process station 31 (31Y, 31M, 31C, 31Bk) has a photosensitive drum 1 (1Y, 1M, 1C, 1Bk), a primary charger 2 (2Y, 2M, 2C, 2Bk), a developing apparatus 8 (8Y, 8M, 8C, 8Bk) and a drum cleaner 10 (10Y, 10M, 10C, 10Bk), and the photosensitive drum 1, the charger 2, the developing apparatus 8 and the drum cleaner 10 are integrally made into a process cartridge which is made detachably mountable with respect to the main body of the image forming apparatus.

A transferring blade 4 (4Y, 4M, 4C, 4Bk) which is transfer charging means abuts against the photosensitive drum 1 with the conveying belt 14 interposed therebetween, and during the transfer of a toner image on the photosensitive drum 1 to the transferring material P, a transferring bias voltage is applied to the transferring blade 4 from a transferring bias power supply 32 (32Y, 32M, 32C, 32Bk) connected thereto.

When in the foregoing, an organic semiconductive electrophotographic photosensitive member (OPC photosensitive member) of the negative polarity is used as the photosensitive drum 1 and the exposed portion of a latent image in which negative charges have been attenuated by the exposure of the photosensitive drum 1 is to be developed, use is made of a developer including a toner of the negative polarity. Accordingly, a transferring bias voltage of the positive polarity is applied from a transferring bias power supply 32 to the transferring blade 4.

The transferring material P is conveyed from a sheet feeding cassette 15 toward the image forming part by a pickup roller 16 and sheet feeding rollers 17 and 18, and is once nipped by and between a pair of registration rollers 19*a* and 19*b* which are roller-shaped synchronous rotary members, and thereafter is supplied to the transferring material sucking part of the conveying belt 14 by the pair of registration rollers 19 in synchronism with the image forming operation on the photosensitive drum 1.

In the sucking part, a sucking roller 20 as sucking charging means is installed in opposed relationship with the sucking opposed roller 22 with the conveying belt 14 interposed therebetween, and the conveying belt 14 and the transferring material P are adapted to be nipped by and between the sucking roller 20 and the opposed roller 22. A voltage (sucking bias voltage) is applied from a sucking bias power supply (high power supply), not shown, to the sucking roller 20, whereby sucking charges are imparted to the transferring material P, and the transferring material P to which the charges have been imparted polarizes the conveying belt 14, whereby the transferring material P is electrostatically sucked to the conveying belt 14.

The transferring material P sucked to the conveying belt 14 in this manner passes through the respective process stations in succession, and yellow, magenta, cyan and black toner images on the respective photosensitive drums 1 are successively superimposed and transferred onto the transferring material P. Thereafter, the transferring material P is separated from the conveying belt 14 and is conveyed to a fixing apparatus 21, where the fixing of the toner images of the four colors is effected, and a full color permanent image is thus obtained on the transferring material P. Any untransferred toner residual on the photosensitive drum 1 after the transfer is removed by the cleaning blade 9 (9Y, 9M, 9C, 9Bk) of the drum cleaner 10, and is collected into the container portion of the cleaner 10.

As the above-described conveying belt 14, use is made of resin film such as polyvinylidene fluoride resin (PVDF), ethylene tetrafluoride-ethylene copolymer resin (ETFE), polyimide, polyethylene terephthalate resin (PET) or polycarbonate having a thickness of 50 to 200 $\mu$m and volume resistivity of the order of $10^9$ to $10^{16}$ Ωcm, or a rubber sheet comprising a substrate layer of rubber such as ethylene-propylene-diene three component copolymer (EPDM) having a thickness of the order of 0.5 to 2 mm, and covered with a coating consisting, for example, of urethane rubber having fluorine resin such as polytetrafluoroethylene (PTFE) dispersed therein.

In general the conveying belt 14 does not bear toner images on its surface directly and therefore is little contaminated by the toners, but during the jam of the transferring material or during the adherence of fog toners to the non-image bearing portions of the photosensitive drums 1, or at the starting of a system in which a registration mark or a density detection pattern is directly formed on the conveying belt 14, and it is detected and used for image control, the toners adhere onto the conveying belt 14 and contaminate it.

So, a belt cleaner 24 is provided to remove the contaminative toners on the conveying belt 14. Alternatively, the cleaning process of applying a cleaning bias voltage opposite in polarity to the bias voltage during the transfer to the transferring blade 4 in each process station 31 to thereby shift the contamination toners on the conveying belt 14 to the photosensitive drum 1, and collecting such toners into the drum cleaner 10 is carried out.

FIG. 5 shows a conventional image forming apparatus of the intermediate transferring member type. This apparatus is a full color image forming apparatus provided with a plurality of process stations along an intermediate transferring belt as an intermediate transferring member. In FIG. 5, members with the same numerals as those in FIG. 4 corresponds to the same members.

In the image forming apparatus using the conveying belt, the toner image of each color formed in each process station is directly transferred to the transferring material, whereas in the image forming apparatus using the intermediate transferring belt 27, toner images of respective colors formed in respective process stations 31 (31Y, 31M, 31C, 31Bk) are once primary-transferred to the intermediate transferring belt 27 and are superimposed, whereafter the toner images are collectively secondary-transferred onto the transferring material P.

The intermediate transferring belt 27 is passed over a drive roller 23, a tension roller 13 and a secondary transferring opposed roller 28, and as the intermediate transferring belt 27, use is made of a belt made of synthetic resin or a belt made of rubber.

By a process similar to that described with reference to FIG. 4, image formation is effected at predetermined timing in the respective process stations 31, and toner images formed on the photosensitive drums 1 (1Y, 1M, 1C, 1Bk) are successively primary-transferred onto the intermediate transferring belt 27 in respective primary transferring parts opposed to the primary transferring blades 4 (4Y, 4M, 4C, 4Bk), to thereby form a full color image comprising toner images of the four colors, i.e., yellow, magenta, cyan and black superimposed one upon another, and the toner images of the four colors on the intermediate transferring belt 27 are collectively secondary-transferred onto the transferring material P supplied to the secondary transferring part of the intermediate transferring belt 27 at predetermined timing via sheet feeding rollers 17, 18, registration rollers 19, etc., by a secondary transferring roller 29. The transferring material P subjected to the transferring step is conveyed to the fixing apparatus 21, where it is heated and pressurized and the toner images are fixed as a permanent image on the surface of the transferring material.

In the image forming apparatus of the electrophotographic type as described above, requirements for a higher speed and a higher quality of image have been heightening year by year and further, similar requirements are also heightening for transferring materials differing in nature from generally popular copying paper such as a transparency for overhead projector (hereinafter referred to as OHT) or thick paper.

Particularly about a higher quality of image, it is one of the most important elements to optimize the transferring bias voltage in the transfer charging means in conformity with the nature of the transferring material. However, the optimum transferring bias voltage for respective transferring materials has been changed, for example, by the state of the fluctuation of the ambient environment (temperature and humidity) or the fluctuation of the moisture content of the transferring material itself, and has been a great hindrance to a higher quality of image.

As regards the achievement of a higher quality of image for transferring materials of high electrical resistance as typified by thick paper or the like, in this case, a high transferring bias voltage becomes necessary as compared with popular copying paper. However, to apply a high transferring bias voltage, not only a correspondingly expensive power supply becomes necessary, but also in the full color image forming apparatus of the tandem type as shown in FIG. 4, a greater bias voltage is required in a more downstream station and therefore, the destruction of the insulation of the photosensitive drums and the belt has posed a problem.

As one of means for solving such a problem, there is known, for example, Japanese Patent Application Laid-Open No. 6-27837 or Japanese Patent Application Laid-Open No. 11-161035.

Both of the techniques of these publications make it possible to pre-charge the transferring material on the conveying belt immediately before toner images are transferred to the transferring material, to thereby suppress the transferring bias voltage required for the transfer of the toner images to a low level.

In these techniques, however, the bias voltage for the pre-charging is primarily set depending on whether the transferring material is a high-resistance transferring material, and the differences between the states of individual transferring materials such as the kinds, moisture contents and surface resistance values of the transferring materials are not taken into account, and such techniques have been insufficient from the viewpoint of a higher quality of image.

Further, provision is not made of means for discriminating whether the transferring material is a high-resistance transfer material, and this has been left to the user's judgement. Thick paper, OHT, etc. include what do not come under the category of high-resistance transferring material but yet are commercially available, and it becomes a factor which deteriorates the quality of image to effect the pre-charging for the high-resistance transferring material in case of image formation on such transferring materials.

Specifically, when pre-charging is effected by a predetermined bias voltage on low-resistance OHT or OHT greatly reduced in resistance under a high humidity environment, bad charging has sometimes occurred. That is, when OHT has become low in resistance due to its environment, the pre-charging bias voltage becomes excessively great to the OHT or charges once accumulated by the pre-charging escape halfway, and in the central portion wherein charges remain, the transferring bias voltage is too weak and the image becomes faint due to bad transfer, and in the end portions from which charges have escaped, the transferring bias voltage is too strong and leak occurs, and likewise the image becomes faint due to bad transfer. As the result, it has been found by the applicant's investigation that as shown in FIG. 6 which shows the case of a solid image, a bad image of which the black portion assumes a doughnut-like shape (doughnut phenomenon) is caused.

There has also been proposed the technique of providing a current detecting mechanism for a high power supply circuit for applying the transferring bias voltage, applying a predetermined bias voltage during the non-supply of sheets or during the passage of the leading edge blank portion of a transferring material and detecting the then flowing current value to thereby detect the ambient environment or discriminate the electrical resistance value of the transferring material, and optimizing the transferring bias voltage on the basis of these.

However, the requirement for a higher speed has heightened simultaneously with the requirement for a higher quality of image and for this, it is necessary to increase the process speed. As the result, there arises the problem that the time during which the blank portion on the leading edge of the transferring material passes the transfer charging means, i.e., the time during which the discrimination of the electrical resistance value of the transferring material can be effected, becomes short and the accuracy of the discrimination lowers or wrong discrimination is effected and the mechanism does not effectively act for the higher quality of image which is the original purpose.

So, in Japanese Patent Application Laid-Open No. 6-35337, there is described the technique of discriminating the electrical resistance of a transferring material from the current value when a detection bias voltage is applied in a sucking portion. According to this, the discrimination of the electrical resistance value can be effected during the time from after the transferring material has come into a sucking part until it comes into a transferring part, and it seems that the time required for this can be sufficiently secured.

However, in order that the discrimination of the electrical resistance value may be accurately effected for a transferring material of a high electrical resistance value such as thick paper or OHT, it is preferable to stepwisely apply the detection bias voltage up to a reasonably high bias area. If a high bias voltage is stepwisely applied to such a transferring material, charges corresponding to the applied bias voltage will remain in terraces on the surface of the transferring material, and this will cause terraced unevenness in the transfer of a toner image in the transferring part. After all, to prevent this, the discrimination of the electrical resistance value must be effected in the blank portion on the leading edge of the transferring material, and like the discrimination in the transferring part, the discrimination in only the sucking part has been insufficient as a measure for a higher speed.

SUMMARY OF THE INVENTION

It is an object of the present invention to provide an image forming apparatus which can effect good transfer irrespective of transfer materials.

It is another object of the present invention to provide an image forming apparatus comprising an image bearing body bearing a toner image thereon, transferring means for transferring the toner image on the image bearing body to a transferring material, and charging means having a voltage applied thereto to thereby charge the transferring material before the transfer by the transferring means, wherein the voltage applied to the charging means is controlled on the basis of a current produced when the leading edge portion of the transferring material is charged by the charging means.

It is another object of the present invention to provide an image forming apparatus comprising an image bearing body bearing a toner image thereon, transferring means having a voltage applied thereto to thereby transfer the toner image on the image bearing body to a transferring material in a transferring part, charging means for charging the transferring material before the transfer by the transferring means, and detecting means for detecting a current produced when a voltage is applied to the charging means, wherein the voltage applied to the transferring means when the image-formed portion of the transferring material passes the transferring part is controlled on the basis of a current produced by a predetermined voltage being applied to the transferring means when the leading edge portion of the transferring material passes the transferring part, and the predetermined voltage is controlled on the basis of the output from the detecting means.

It is another object of the present invention to provide an image forming apparatus comprising an image bearing body bearing a toner image thereon, transferring means having a voltage applied thereto to thereby transfer the toner image on the image bearing body to a transferring material in a transferring part, charging means for charging the transferring material before the transfer by the transferring means, and detecting means for detecting a voltage produced when a current is applied to the charging means, wherein the voltage applied to the transferring means when the image-formed portion of the transferring material passes the transferring part is controlled on the basis of a current produced by a predetermined voltage being applied to the transferring means when the leading edge portion of the transferring material passes the transferring part, and the predetermined voltage is controlled on the basis of the output from the detecting means.

It is another object of the present invention to provide an image forming apparatus comprising an image bearing body bearing a toner image thereon, a transferring material bearing body bearing a transferring material thereon, transferring means for transferring the toner image on the image bearing body to the transferring material borne on the transferring material bearing body, charging means having a voltage applied thereto to thereby charge the transferring material borne on the transferring material bearing body in a charging part before the transfer by the transferring means, and detecting means for detecting a current produced when a voltage is applied to the transferring material bearing body on which the transferring material is not borne, wherein the voltage applied to the charging means when the transferring material passes the charging part is controlled on the basis of the output from the detecting means.

It is another object of the present invention to provide an image forming apparatus comprising an image bearing body bearing a toner image thereon, a transferring material bearing body bearing a transferring material thereon, transferring means for transferring the toner image on the image bearing body to the transferring material borne on the transferring material bearing body, charging means having a voltage applied thereto to thereby charge the transferring material borne on the transferring material bearing body in a charging part before the transfer by the transferring means, and detecting means for detecting a voltage produced when a current is applied to the transferring material bearing body on which the transferring material is not borne, wherein the voltage applied to the charging means when the transferring material passes the charging part is controlled on the basis of the output from the detecting means.

It is another object of the present invention to provide an image forming apparatus comprising an image bearing body bearing a toner image thereon, transferring means having a voltage applied thereto to thereby transfer the toner image on the image bearing body to a transferring material being conveyed in a transferring part, and charging means having a voltage applied thereto to thereby charge the transferring material in a charging part before the transfer by the transferring means, wherein when in the conveying direction of the transferring material, the length of the transferring material is greater than the distance from the charging part to the transferring part, the voltage applied to the transferring means is changed over at timing whereat the trailing edge portion of the transferring material passes the charging part.

Further objects of the present invention will become apparent from the following description.

DESCRIPTION OF THE PREFERRED EMBODIMENTS

An image forming apparatus according to the present invention will hereinafter be described with reference to the drawings.

Figure 1:
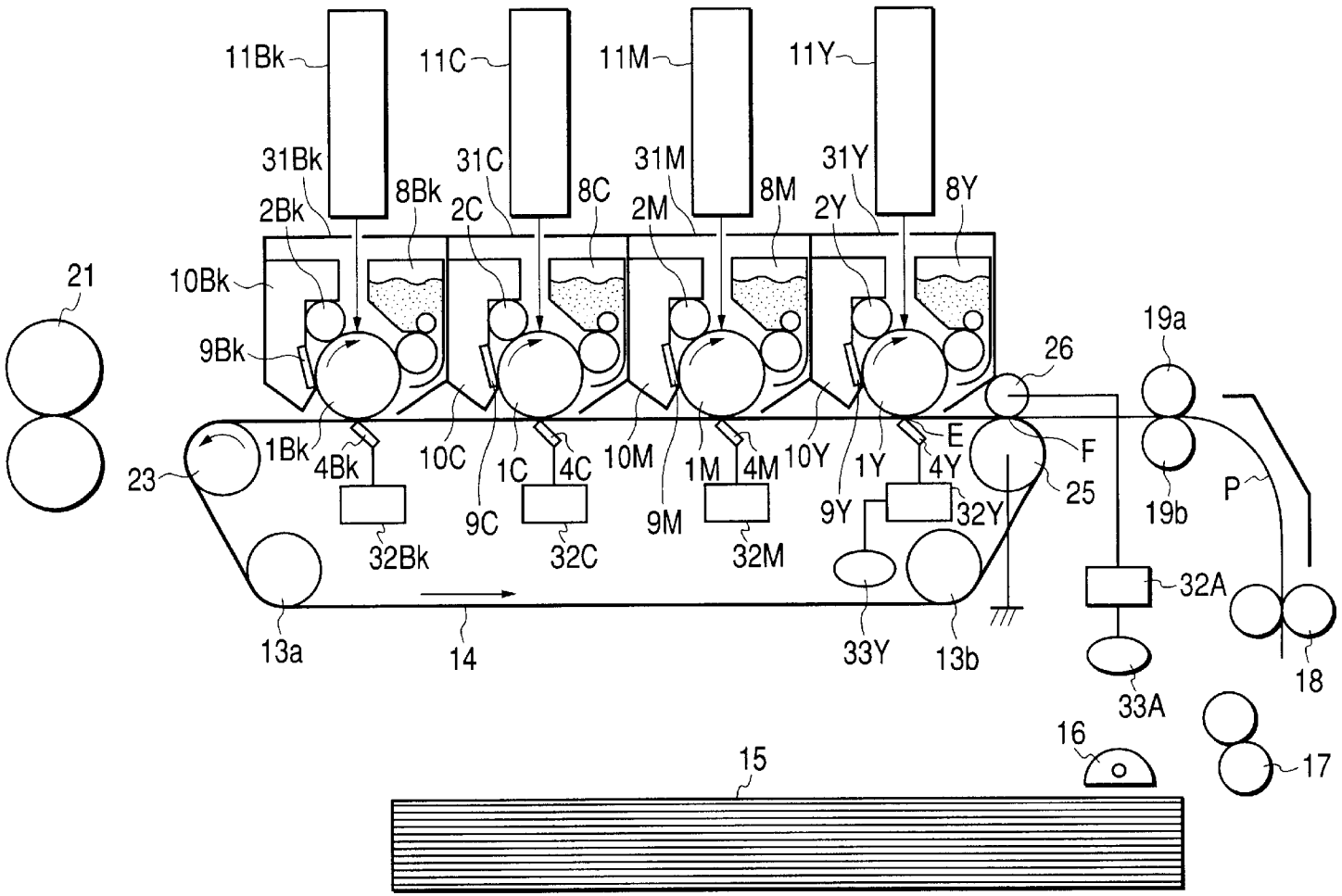
FIG. 1 shows an image forming apparatus which is an embodiment of the present invention.

FIG. 1 shows the construction of an embodiment of the image forming apparatus of the present invention. This apparatus is constructed as a full color image forming apparatus of the tandem in-line type.

In the present invention, a charging roller 26 as before-transfer charging means is installed on the upstream side of a first image forming station of a conveying belt 14 so that a detecting bias voltage may be applied to the charging roller 26 prior to transfer to thereby preliminarily detect the kind of a transferring material P, and on the basis thereof, a pre-charging bias voltage, a transferring bias voltage, etc. may be set.

The image forming apparatus of the present embodiment has a conveying belt (electrostatic sucking belt) 14 as a transferring material bearing body, and the conveying belt 14 is passed over a drive roller 23, a before-transfer charging opposing roller 25 and tension rollers 13*a* and 13*b*, and is rotatively driven in the direction of arrow by the drive roller 23.

Along the peripheral surface of this conveying belt 14, process stations 31Y, 31M, 31C and 31Bk are disposed as yellow (Y), magenta (M), cyan (C) and black (Bk) image forming parts, and the transferring material is conveyed to the respective process stations in succession by the conveying belt 14. Each process station 31 (31Y, 31M, 31C, 31Bk) has a photosensitive drum 1 (1Y, 1M, 1C, 1Bk), a primary charger 2 (2Y, 2M, 2C, 2Bk), a developing apparatus 8 (8Y, 8M, 8C, 8Bk) and a drum cleaner 10 (10Y, 10M, 10C, 10Bk), and the photosensitive drum 1, the primary charger 2, the developing apparatus 8 and the drum cleaner 10 are integrally made into a process cartridge, which is made detachably mountable with respect to the main body of the image forming apparatus.

A toner image of each color is formed on the photosensitive drum 1 of each process station via the uniform charging by the primary charger 2, the exposure 12 (12Y, 12M, 12C, 12Bk) by exposing means 11 (11Y, 11M, 11C, 11Bk) and the development by the developing apparatus 8.

A transferring blade 4 (4Y, 4M, 4C, 4Bk) which is transferring means abuts against the photosensitive drum 1 with the conveying belt 14 interposed therebetween, and during the transfer of the toner image on the photosensitive drum 1 to the transferring material P, a transferring bias voltage is applied to the transferring blade 4 from a transferring bias power supply 32 (32Y, 32M, 32C, 32Bk) connected thereto.

The transferring material P which is a recording material is conveyed from a sheet feeding cassette 15 or the like toward the image forming part by a pickup roller 16 and sheet feeding rollers 17 and 18, and is once nipped by and between a pair of registration rollers 19 (19*a*, 19*b*) which are roller-shaped synchronous rotary members, and thereafter is supplied to the before-transfer charging part F of the conveying belt 14 in which the charging roller 26 is installed, in synchronism with the image forming operation on the photosensitive drum 1 by the pair of registration rollers 19.

The charging roller 26 which is the charging means is installed in opposed relationship with the opposed roller 25 with the conveying belt 14 interposed therebetween, and is adapted to nip between it and the opposed roller 25 the transferring material P supplied to the charging part F with the conveying belt 14, and apply an before-transfer charging bias voltage from a before-transfer charging power supply 32A to the transferring material P through the charging roller 26.

This charging roller 26 has the function as sucking charging means for causing the transferring material to be sucked to the conveying belt and the function as pre-charging means for pre-charging the transferring material prior to transfer, and applies the pre-transfer charging bias voltage to the transferring material P to thereby impart charges to the transferring material P. Thereby, the transferring material P to which the charges have been imparted polarizes the conveying belt 14, and the transferring material P is electrostatically sucked to the conveying belt 14, and prior to transfer, the transferring material P is preliminarily charged.

In the present embodiment, the charging roller 26 is given the function of the pre-charging means for the transferring material and therefore, the before-transfer charging bias voltage is of a polarity opposite to the polarity of a developer (toner), and since a toner of a negatively charging characteristic is used as the toner, the before-transfer charging bias voltage is of the positive polarity (the surface of the transferring material is charged to the positive polarity).

In the present invention, in the leading edge portion of the transferring material, a current value flowing through the charging roller 26 or a voltage value produced in the charging roller 26 during the application of the bias voltage from the before-transfer charging power supply 32A is detected by charging bias voltage detecting means 33A (first detecting means) connected to the charging power supply 32A, whereby the kind and characteristic of the transferring material P are preliminarily discriminated.

When it is discriminated that the transferring material P is a high-resistance transferring material, the level of the pre-charging bias voltage (before-transfer charging bias voltage) is set to a high level as compared with that for other transferring materials, whereby there is obtained the effect of reducing the transferring bias voltage in a transferring part E. That is, in the present embodiment, the absolute value of the voltage applied to the charging roller 26 in a portion corresponding to the image-formed area of the transferring material is greater when the transferring material is a resin sheet such as OHT or thick paper than when the transferring material is plain paper.

Preliminarily charging the transferring material P prior to transfer as described above has the action of reducing the transferring bias voltage for a transferring material of a high electrical resistance value such as OHT or thick paper in particular, and is particularly effective for the image forming apparatus of the tandem in-line type being described in the present embodiment.

The transferring material P sucked to the conveying belt 14 in this manner passes the respective process stations in succession, and the yellow, magenta, cyan and black toner images on the respective photosensitive drums 1 are successively superimposed and transferred. Thereafter, the transferring material P is separated from the conveying belt 14 and is sent to a fixing apparatus 21, where the fixing of the toner images of the four colors is effected and a full color permanent image is obtained on the transferring material P. Any untransferred toners residual on the photosensitive drums 1 after transfer are removed by the cleaning blades 9 (9Y, 9M, 9C, 9Bk) of the drum cleaner 10, and are collected into the container portion of the cleaner 10.

According to our investigation, resin film such as PVDF, ETFE, polycarbonate, PET or polyimide having a thickness of 100–200 $\mu$m and resistance-adjusted to volume resistivity of the order of $10^8$ to $10^{13}$ Ωcm is good in sucking property and transferring property as the conveying belt 14 and in addition, has a moderate self-attenuating property and therefore has such an advantage as the capability of preventing the charging-up of the belt even if charge removing means is not provided, and is suitable for the application used in the present embodiment.

In the present embodiment, as the conveying belt 14, use is made of a belt of ETFE resin film having volume resistivity of the order of $10^{11}$ Ωcm by the dispersion of carbon or the like and having a thickness of 100 $\mu$m and a peripheral length of 800 mm.

The charging roller 26 is an electrically conductive roller comprising ethylene-propylene-diene three component copolymer (EPDM) rubber having had its volume resistivity adjusted to $10^5$ Ωcm or less by carbon dispersion and formed to a thickness of 3 mm on a mandrel having a diameter of 6 mm. According to our investigation, preferably the volume resistivity of the charging roller 26 is $10^4$ to $10^{10}$ Ωcm. As the member of the before-transfer charging means, use may be made of a contact charging member such as a blade or a brush, or a non-contact charging member such as a corona charger, besides the above-described roller.

The opposed roller 25 of the charging roller 26 is a metal roller, and is used with its bearing portion electrically grounded.

An example of the transferring blade 4, use is made of PET film having a thickness of 100 $\mu$m and volume resistivity of $10^5$ Ωcm, and this is made to abut against the conveying belt 14 at an angle of 45° with a pressure force applied thereto so as to be in a forward direction relative to the direction of rotation (the direction of arrow) of the conveying belt 14, and the pressure force is of a magnitude with which the transferring blade restores toward the photosensitive drum by about 0.5 mm when the conveying belt and the photosensitive drum have been removed. As the transferring blade 4, use can also be made of film of any other material than that mentioned above if its volume resistivity is substantially within the range of $10^2$ to $10^9$ Ωcm. Of course, as the transferring means, use may also be made of a rubber roller of the sponge type or the solid type having a similar volume resistivity range, or use may also be made of a member of the non-contact type such as a corona charger.

In the present invention, the volume resistivities of the various members including the above-described conveying belt 14 and charging roller 26 are obtained by measuring with a measuring probe in conformity with Japanese Industrial Standard (JIS) K6911 in the condition of applying by a high resistance meter (model R8340) produced by ADVANTEST, Inc., and normalizing the measured value by the thickness of the object to be measured.

As the drive roller 23, use is made of a mandrel which is a metal roller covered with a rubber layer for preventing slippage having a thickness within the range of about 0.5 to 3.0 mm. As an example, use was made of a roller of the insulating type in which the resistance of the rubber layer is $10^{15}$ Ωcm or greater, but use may be made of one of low resistance. The drive roller 23 and the tension rollers 13*a* and 13*b* have no member (electrode) opposed thereto with the conveying belt 14 interposed therebetween and the conveying belt 14 itself is a self-attenuating system and therefore, the mandrels of these rollers may be either grounded or floating.

Figure 2:
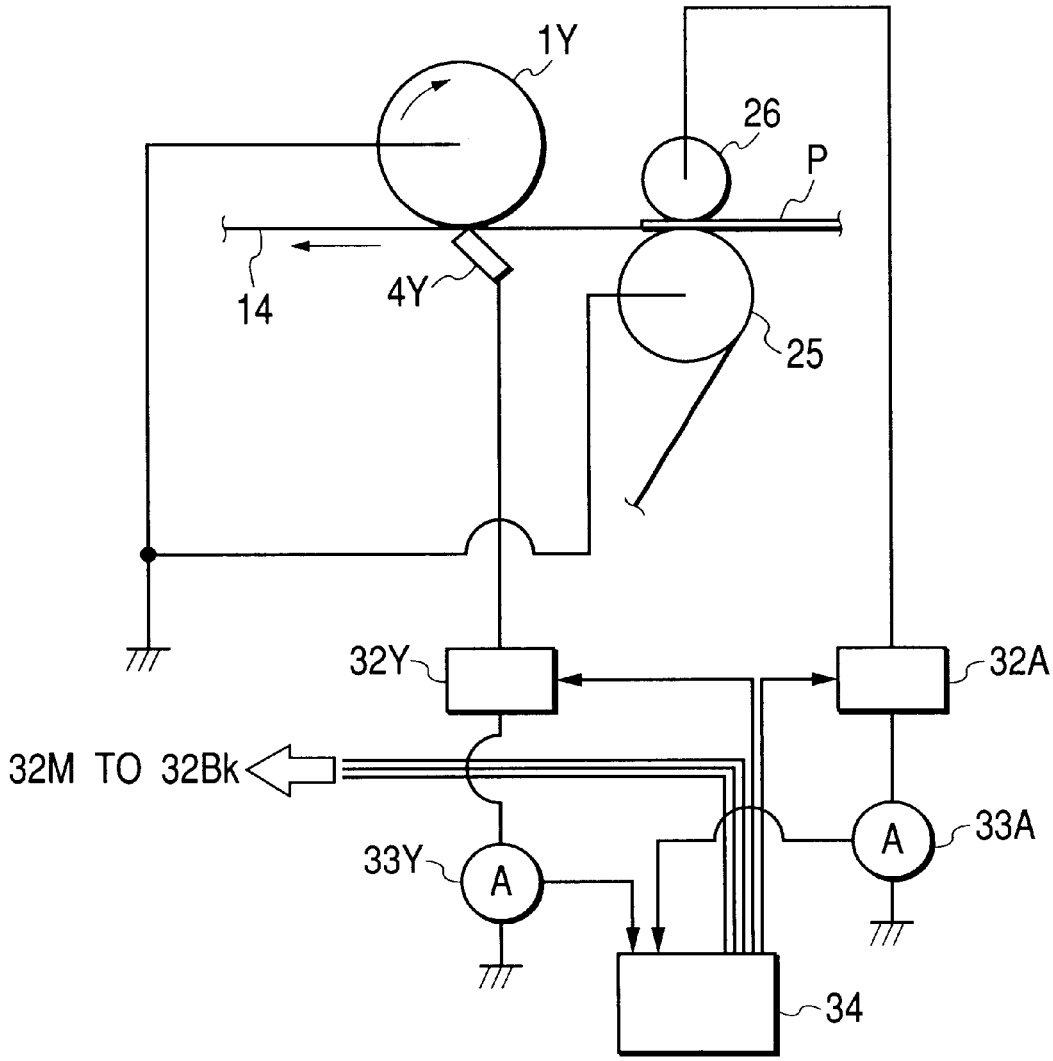
FIG. 2 shows an example of the power supply circuit of before-transfer charging means and transferring means in the present invention.
Figure 3:
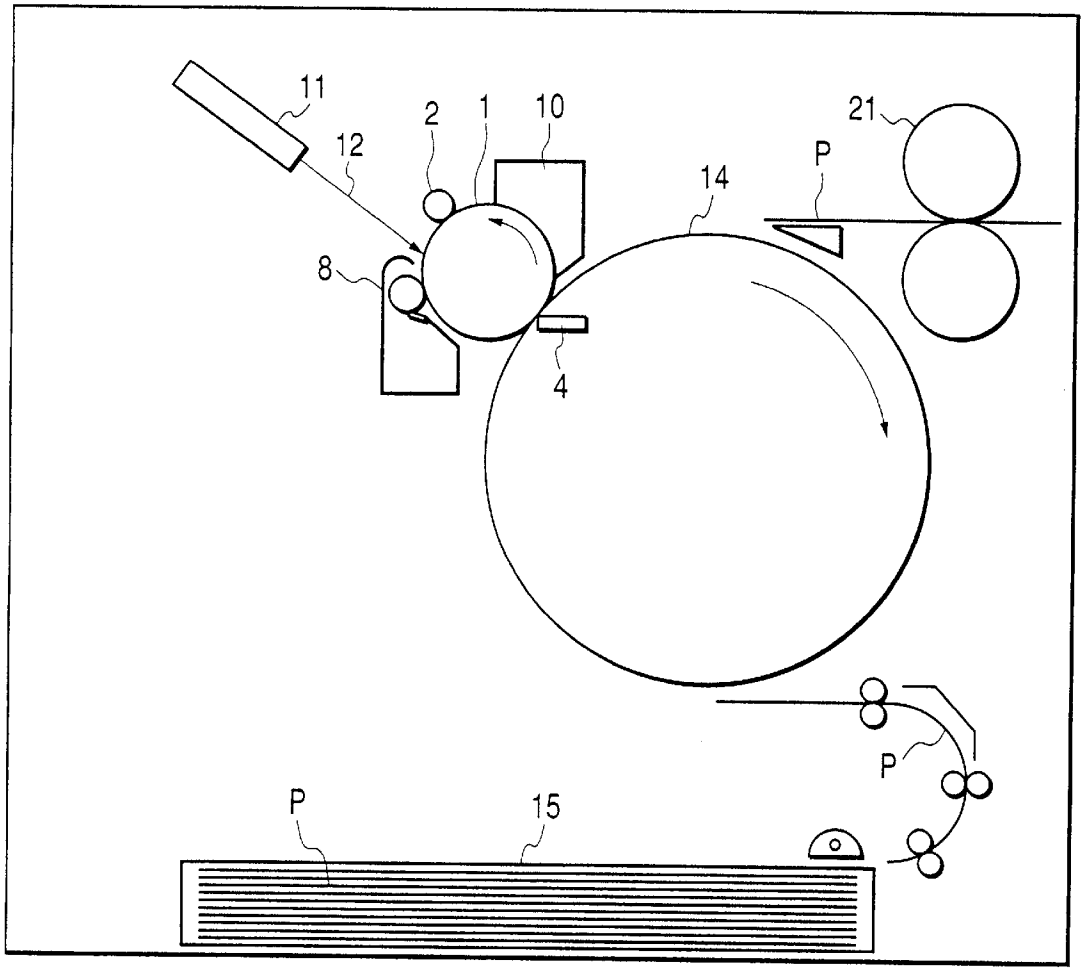
PRIOR ART FIG. 3
FIG. 3 shows a conventional image forming apparatus.
Figure 4:
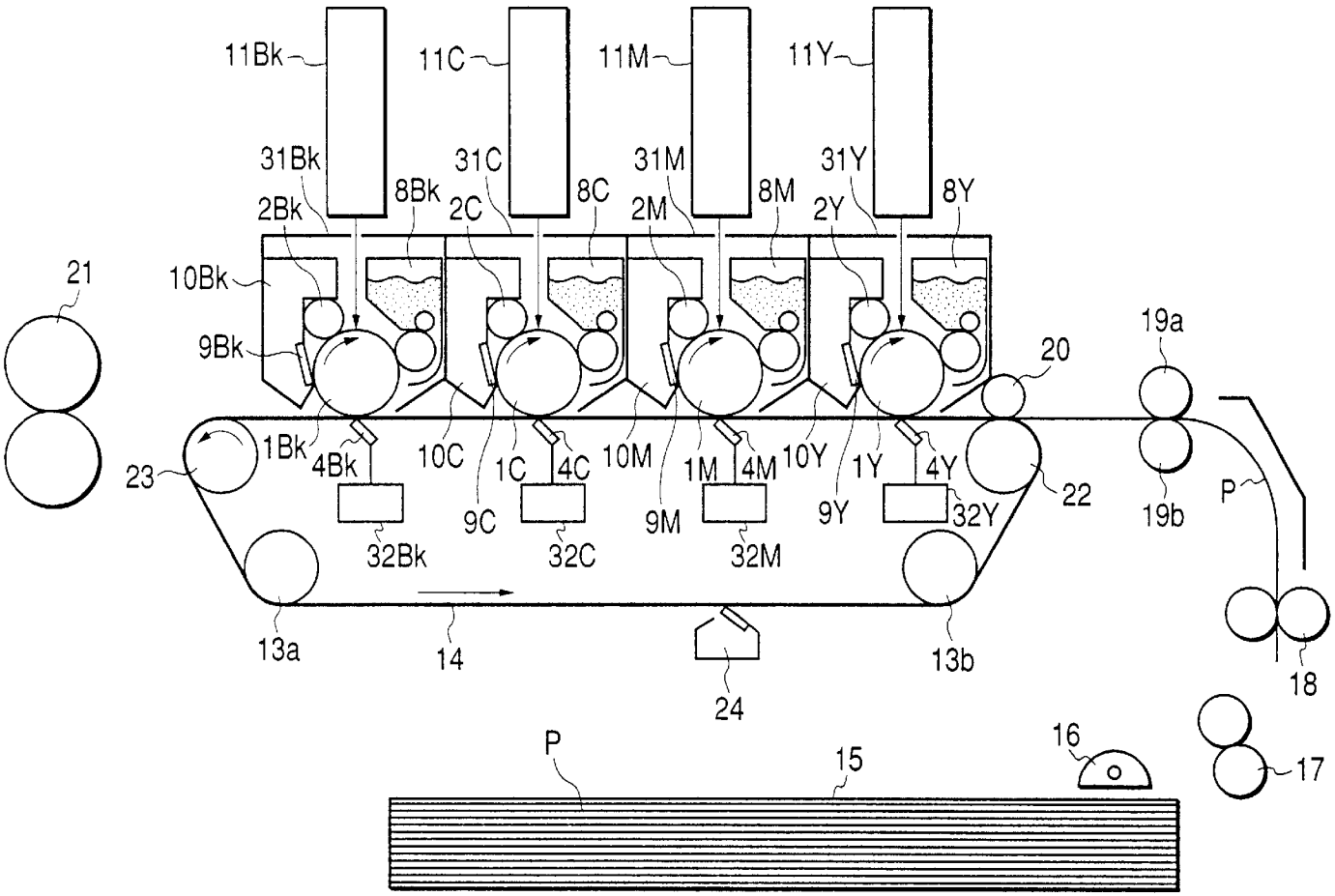
PRIOR ART FIG. 4
FIG. 4 shows another conventional image forming apparatus.
Figure 5:
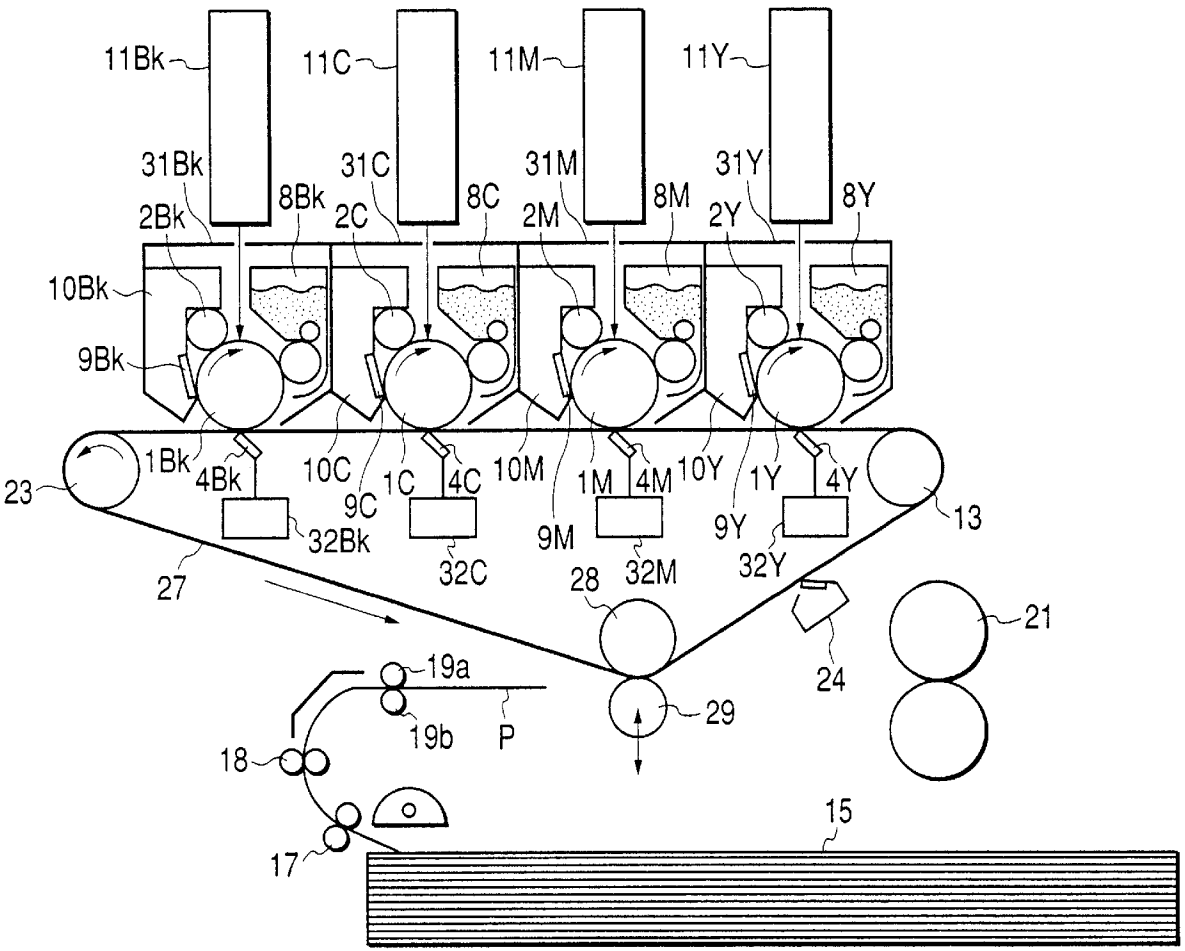
PRIOR ART FIG. 5
FIG. 5 shows still another conventional image forming apparatus.
Figure 6:
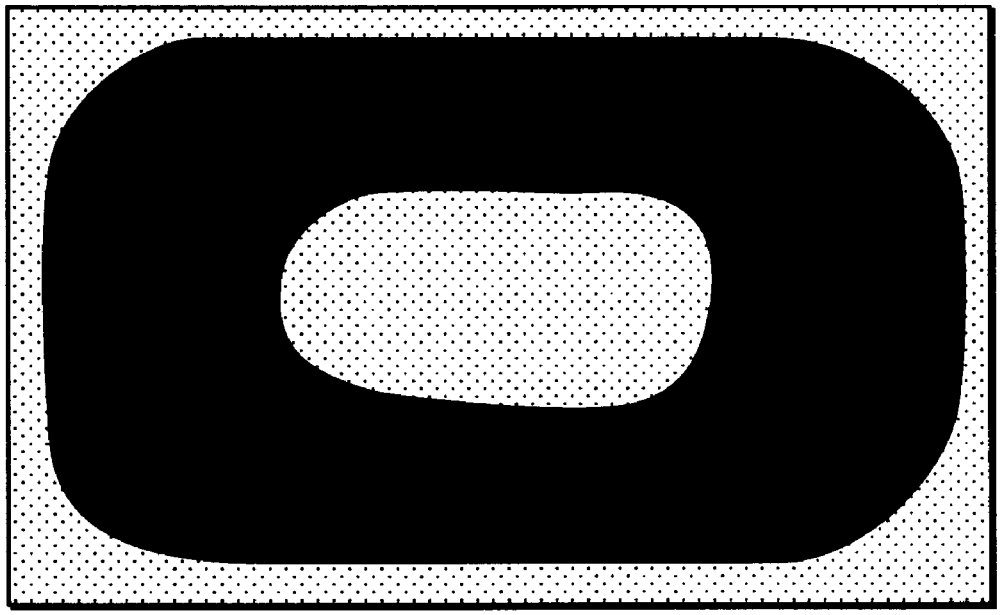
FIG. 6 shows the doughnut phenomenon of a solid image.

FIG. 2 shows a typical view of an example of the power supply circuit of the charging means and the transferring means in the present invention.

The before-transfer charging power supply 32A for applying a before-transfer charging bias voltage to the charging roller 26 is connected to detecting means (first detecting means) 33A, which is designed to be capable of detecting a current value flowing through the power supply 32A during the application of the charging bias voltage when the output of the before-transfer charging power supply 32A is constant-voltage-controlled, and detecting a voltage value produced in the power supply 32A during the application of the charging bias voltage when the aforementioned output is constant-current-controlled.

Likewise, the transferring power supply 32Y for applying a transferring bias voltage to the transferring blade 4Y of the first process station is connected to detecting means (second detecting means) 33Y, which is designed to be capable of detecting a current value flowing through the power supply 32Y during the application of the transferring bias voltage when the output of the transferring power supply 32Y is constant-voltage-controlled, and detecting a voltage value produced in the power supply 32Y during the application of the transferring bias voltage when the aforementioned output is constant-current-controlled.

Also, the detecting means 33A and 33Y, the before-transfer charging power supply 32A and the transferring power supplys 32 (32Y-32Bk) of the respective process stations are connected to a calculation control device (CPU) 34 so that the outputs of the power supplys 32A and 32 can be arbitrarily controlled in conformity with the results of the detection by the detecting means 33A and 33Y.

In the present invention, the pre-charging bias voltage and the transferring bias voltage are set by the application of the detecting bias voltage by the before-transfer charging power supply and the transferring power supply of the first process station. Description will hereinafter be made with a case where the before-transfer charging power supply and the transferring power supply of each station are constant-voltage-controlled taken as an example.

The transferring material P, as previously described, is supplied from the sheet feeding cassette 15 or the like to the charging part F of the conveying belt 14 via the rollers 16, 17 18 and 19. At this stage, a present detecting bias voltage is applied from the before-transfer charging power supply 32A to the transferring material P through the charging roller 26, and a current value flowing through the power supply 32A at that time is detected by the first detecting means 33A, and the detected current value is sent to the calculation control device 34 and is processed thereby.

The application of the detecting bias voltage by this charging roller 26 may become a factor which pre-charges a transferring material of a high electrical resistance value under an in appropriate condition and causes the lowering of the quality of image during the transfer of the toner image to the transferring material and therefore, it is desirable that a series of operations such as the application of the detecting bias voltage and the detection of the resulting current value be performed in a blank portion (non-image-formed area) set on the leading edge portion of the transferring material.

The setting of various process conditions such as the pre-charging bias voltage and the transferring bias voltage is selectable on the basis of the result of the detection of the current value by the detecting means 33A. To achieve a higher quality of image, it is important to accurately discriminate the kind and characteristic of the transferring material by the charging roller 26 and for this purpose, it is desirable that the detecting bias voltage to be applied by the charging roller 26 be applied at a plurality of stages. If the current values by the respective ones of the detecting bias voltage applied at the plurality of stages are detected, it will become possible to discriminate the kind and characteristic of the transferring material in greater detail.

The detecting bias voltage may be applied with the bias voltage thereof preset by the kind of the transferring material and an appropriate bias voltage value selected in conformity with the kind of the transferring material, or may be applied with a bias voltage value suitable for the transferring material calculated by the calculation control device 34 on the basis of the result of the detection by the detecting means 33A by feedback control.

In this manner, it becomes possible to discriminate the kind and characteristic of the transferring material by the calculation control device 34 on the basis of the application of the detecting bias voltage by the charging roller 26 and the current value thereby, and calculate and set the set values of various process conditions such as the optimum before-transfer charging bias voltage value (pre-charging bias voltage value) and transferring bias voltage value conforming to the kind and characteristic of the transferring material. It is also possible to obtain the electrical resistance value or the like of the transferring material as required.

In the setting of the pre-charging bias voltage (before-transfer charging bias voltage), it is of course desirable to set it finely in conformity with the kind of the transferring material and the situations of individual transferring materials, but if it is taken into account that its degree of influence is small as compared with the transferring bias voltage directly concerned in the transfer of the toner image and that with the heightening of speed, a limitation occurs to the accuracy of the detection within only the range of the blank portion set on the leading edge of the transferring material, it is preferable to control it stepwisely with such a degree of accuracy as will not cause wrong detection.

A specific example of the discrimination of the kind of the transferring material and the setting of the pre-charging bias voltage by the above-described before-transfer charging will be described below with a case where OHT for color printer (CG3700) produced by 3M Co., Ltd. was used as the transferring material P under low-temperature and low-humidity (15° C., 10%) environment taken as an example.

First, in OHT printing, in order to obtain sufficient transmitting performance during fixing, it is necessary to make the speed of each image forming process (process speed) lower than that during the use of an ordinary transferring material (plain paper), and in the present example, the process speed was reduced to the order of ⅓ of that during the ordinary time. The fixing control temperature may be changed as required.

The change of the process speed or the like may be automatically set by the automatic detection of OHT by a sensor of the light transmission type or the like, or may be set by manual inputting.

A preset voltage, e.g. +2.0 kV is applied as the detecting bias voltage at the first stage to the OHT conveyed to the charging roller 26, and a current value flowing at this time is detected and read by the first detecting means 33A. The current value detected at this time is e.g. 0.5 $\mu$A, and this current information is sent to the calculation control device 34, and it is recognized by the calculation control device 34 that the transferring material is of a kind having a high electrical resistance value, here, OHT, because 0.5 $\mu$A is a relatively small value as a current value.

The target current value in the pre-charging to a transferring material of a high electrical resistance value (OHT) is stored in advance in the calculation control device 34 with the objects of the discrimination of the more detailed characteristic of OHT and the appropriate pre-charging of OHT. The calculation control device 34, when as described above, it recognizes that the transferring material is OHT, effects feedback control e.g. about three times in an area higher in the output voltage setting than for other transferring material such as paper, to the before-transfer charging power supply 32A, so that this target pre-charging current value, e.g. 2.0 μA may be obtained by the first detecting means 33A. At this time, the output voltage difference to be fluctuated by one cycle of feedback control was set so as to be of the order of 500V.

The above-described voltage application at the first stage and the three times of feedback control, thus four times of voltage application in total, were all effected within the range of 5 mm for a blank portion preset on the leading edge of OHT. Thereby, there was obtained the more detailed characteristic of the transferring material, for example, the result that a current of 2.2 μA flows for the application of a voltage of +3.0 kV. In this manner, the pre-charging bias voltage value +3.0 kV is determined. Subsequently, OHT was pre-charged at +3.0 kV.

As the result, a value of 2.2 μA relatively approximate to the target pre-charging current value of 2.0 μA could be obtained for the area from the blank portion of 5 mm on the leading edge of OHT to the trailing edge portion. Incidentally, when similar control is applied to OHT left under a high-humidity environment, the voltage for which the target pre-charging current value is obtained becomes a small value, e.g. +1 kV or so.

The pre-charging need not be effected when printing (image formation) is effected on ordinary copying paper, but yet the pre-charging becomes effective as for OHT during image formation on a second surface of the transferring material when images are to be successively formed on first and second surfaces of the transferring material (both-surface image formation) in which for example, the resistance value of paper rises greatly. In such a case, the process speed is higher than in the case of OHT and therefore, the target pre-charging current value need be made great (e.g. 20 μA), and the voltage for which the target pre-charging current value is obtained is of the order of +1 kV–+2 kV.

The discrimination of the kind of the transferring material by the before-transfer charging means and an example of the setting of the pre-charging bias voltage have been described above.

The transferring material P passed through the charging part F and pre-charged in this manner then starts to come into the transferring part E of the first process station, and in the same manner as one of the description regarding the charging part F, the detecting bias voltage is applied from the transferring power supply 32Y to the blank portion of the leading edge through the transferring blade 4Y while the blank portion on the leading edge which does not affect the quality of image passes, and the current value at that time is detected by second detecting means 33Y, and on the basis of the result thereof, the optimum transferring bias voltage or the like is calculated by the calculation control device 34.

It is desirable when the magnitude of the influence the fluctuation of the transferring bias voltage has upon the quality of image during the transfer of the toner image is taken into consideration that a series of operations of applying the detecting bias voltage by the transferring means 4Y and detecting the current value by the detecting means 33Y be performed within the range of the blank portion of the transferring material, as described above.

To apply the detecting bias voltage by the transferring means, and detect the current value flowing at that time by the detecting means, and effect the setting of the various process conditions on the basis of these results to thereby achieve a higher quality of image, it is required to accurately detect the kind and characteristic of the transferring material by the transferring means. The transferring bias voltage directly affects the quality of the toner image to be transferred and therefore, for a higher quality of image, it is necessary to finely effect the setting of the transferring bias voltage in conformity with the kind and characteristic of the transferring material. Therefore, it is desirable that the detecting bias voltage to be applied by the transferring means be applied at a plurality of separated stages.

Further, it is more preferable that the detecting bias to be applied by the transferring means be set by feedback control by the use of the calculation control device on the basis of the result of the detection by the first detecting means.

In a conventional system, the kind and characteristic of the transferring material are unknown and therefore, to accurately set the optimum transferring bias voltage, it has been necessary to finely set and apply the detecting bias voltage over a wide bias range, and detect their actual bias voltage values at that time, and it has been very difficult to accurately effect the detection within the time during which the blank portion on the leading edge of the transferring material passes.

In contrast, according to the present embodiment, the kind and characteristic of the transferring material are discriminated in advance to a certain degree by the charging part F and therefore, in the transferring part E, the range of the detecting bias voltage for finding out a proper transferring bias voltage can be narrowed on the basis of the result of this discrimination, and it becomes possible to set the condition of the transferring bias voltage within the range of the blank portion of the leading edge of the transferring material.

In this manner, the kind and characteristic of the transferring material can be discriminated in greater detail by the calculation control device 34 on the basis of the application of the detecting bias voltage by the transferring blade 4Y and the current value thereby, and the set values of various process conditions such as an optimum transferring bias voltage value conforming to the kind and characteristic of the transferring material can be calculated and set.

With a case where OHT for color printer (CG3700) produced by 3M Co., Ltd. was used as the transferring material P under low-temperature and low-humidity (15° C., 10%) environment taken as an example, a specific example of the discrimination of the kind of the transferring material and the setting of the transferring bias voltage by the above-described transferring means will be described below.

When the pre-charged OHT is conveyed to the transferring means 4Y of the first process station, a detecting voltage at the first stage for which a preset target transferring current value, e.g. 2.5 μA can be obtained is applied from the transferring means to the pre-charged OHT, and a current value flowing at this time is detected and read by the second detecting means 33Y. As regards the detecting voltage, a voltage of an optimum value, e.g. −1.0 kV, is set by the calculation control device 34 on the basis of the result of the detection by the charging means (a current value of 2.2 μA is obtained for the application of a voltage of +3.0 kV).

The current value detected at this time is e.g. 2.3 μA, and this current information is sent to the calculation control device 34, and feedback control is effected to the transferring means e.g. three times or so. This control is such that because the detecting voltage at the first stage is set with reference to the result of the detection by the charging means, the detected current value becomes very approximate to the target transferring current value. Therefore, it becomes possible for the output voltage difference in the first feedback control to be controlled more finely than the detecting output voltage difference by the charging means (in the present embodiment, this was set as 100V). Thereby, e.g. −0.5 kV can be found as a transferring bias voltage for which the target transferring current value 2.0 $\mu$A can be obtained. This voltage application at the first stage and the three times of voltage application at the feedback control, thus four times of voltage application in total, were all effected within the range of the blank portion 5 mm on the leading edge of OHT.

The optimum transferring bias voltage value is thus determined and that −0.5 kV is applied over the range from the blank portion on the leading edge of OHT to the trailing edge, and the toner image on the photosensitive drum 1Y is transferred to OHT. Further, on the basis of the transferring bias voltage information obtained by the transferring means 4Y of the first process station, the optimum transferring bias voltages in the transferring means 4M-4Bk of the second to fourth process stations were calculated by the calculation control device 34, and the transferring bias voltages to the respective transferring means 4M-4Bk were controlled.

As the result, the transferring bias voltage in the transferring means 4Bk of the last or fourth process station was +3.0 kV, and as compared with the prior art, good transfer could be effected at a low bias voltage, and the destruction of the insulation of the photosensitive drum by the high transferring electric field at the end portions of OHT could be prevented.

An example of the discrimination of the kind of the transferring material and the setting of the transferring bias voltage by the transferring means has been described above.

In our investigation, when OHT was not pre-charged, to obtain a relatively good image, the transferring bias voltage in the last process station was of the order of +6.0 kV, but in the end portions of OHT, the destruction of the insulation of the photosensitive drum occurred. Also, in the result of similar investigation carried out under a high-humidity environment, it became possible to suppress the transferring bias voltage to a low level, and the occurrence of the aforedescribed doughnut phenomenon could also be prevented.

When effecting transfer by the use of ordinary paper, the current detection value used in the above-described pre-charging bias voltage control can also be effectively used for the calculation of the optimum transferring bias voltage value. Again in this case, as during the calculation of the pre-charging bias voltage, it is necessary to suitably change the correspondence relation between the set values of the pre-charging bias voltage and the transferring bias voltage in accordance with the change of the sheet supply speed.

While in the foregoing, the results of the detection obtained by the first detecting means and the second detecting means have been reflected in the setting of the pre-charging bias voltage and the transferring bias voltage, the present invention is not restricted thereto, but it is also possible to reflect these results of the detection in the setting of the other process conditions, for example, various conditions such as the primary charging bias voltage of the photosensitive drum and the developing bias voltage of the developing device, or the process speed of the image forming apparatus and the fixing temperature of the fixing apparatus.

Further, two first and second detecting means are used to effect control of higher accuracy, but only the first detecting means may be used if sufficient accuracy can be secured by the first detecting means.

Also in the present embodiment, as in the prior art, it is possible to apply the detecting bias voltage to the transferring means and the charging means during the non-supply of sheets, and detect the ambient environment from the result of the detection of the then current to thereby effect control of higher accuracy. Further, if the aforementioned detecting bias voltage in the charging means and the transferring means is set in conformity with the ambient environment detected by this method or other means, bias voltage control of better accuracy will become possible.

As described above, according to the present invention, design is made such that in the before-transfer charging part for charging the transferring material on the transferring material bearing body prior to transfer, the detecting bias voltage is applied to the blank portion on the leading edge of the transferring material by the before-transfer charging means, and the kind of the transferring material is discriminated by the technique of detecting the then current value or voltage value, and the pre-charging bias voltage for pre-charging the transferring material or the pre-charging bias voltage and the transferring bias voltage are set on the basis of the current value or the voltage value, and in the transferring part of the first image forming station, the detecting bias voltage is applied to the blank portion on the leading edge of the transferring material by the transferring means, and the kind of the transferring material is more finely discriminated by the technique of detecting the then current value or voltage value, and the transferring bias voltage is set on the basis of the current value or the voltage value in the transferring part and the current value or the voltage value in the before-transfer charging part and therefore, even in high-speed image formation, an optimum transferring bias voltage can be set correspondingly to the kind of the transferring material such as copying paper, thick paper or OHT and the state of each individual transferring material affecting the setting of the transferring bias voltage, without troubling the user, and the toner image can be transferred to the transferring material, and transfer can be effected without effecting the application of a great transferring bias voltage to a transferring material having a high electrical resistance value like OHT, whereby a good image can be obtained.

Now, when as described above, a high pre-charging bias voltage (before-transfer charging bias voltage) is applied, there has been a case where under such high-temperature and high-humidity environment (hereinafter referred to as H/H environment) that the surface resistance of OHT becomes low, the pre-transfer charging current flows to the photosensitive drum 1 through the surface of OHT.

Figure 7A:
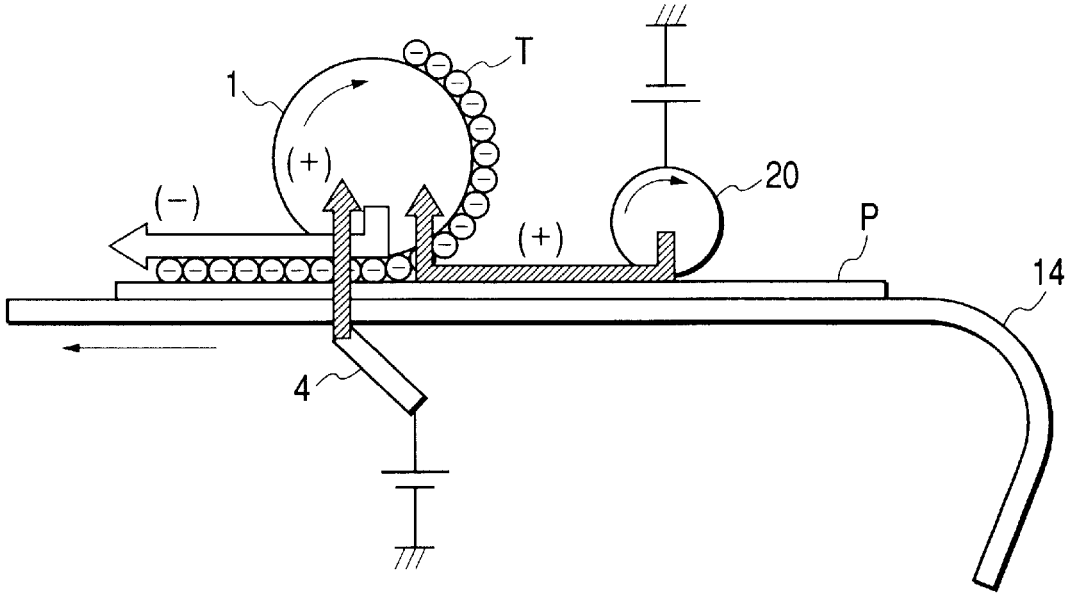
FIGS. 7A and 7B show the states of charges when a transferring material is astride a charging roller and a photosensitive drum and when the transferring material is not astride the charging roller and the photosensitive drum.

This phenomenon will hereinafter be described in detail with reference to FIGS. 7A and 7B. First, in a state as shown in FIG. 7A wherein the transferring material P is in contact with both of the sucking roller 20 and the photosensitive drum 1, the pre-charging current (before-transfer charging current) from the sucking roller 20, in addition to the transferring current from the transferring blade 4, flows into the photosensitive drum 1 through the transferring material P. These two currents are the flows of plus charges and therefore, minus charges corresponding to these two flows of plus charges move from the photosensitive drum 1 to the transferring material P. That is, the toner T on the photosensitive drum 1 having minus charges moves.

Figure 7B:
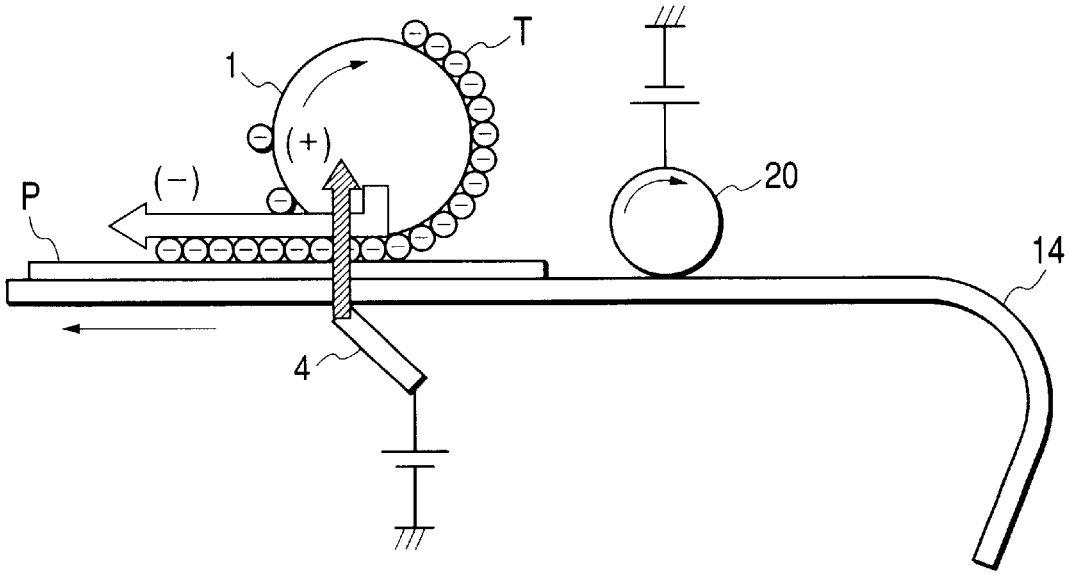

On the other hand, when there is brought about a state as shown in FIG. 7B wherein the transferring material P is separate from the sucking roller 20 and is in contact with only the photosensitive drum 1, only the transferring current from the transferring blade 4 flows into the photosensitive drum 1. Accordingly, as compared with the case of FIG. 7A, the amount of movement of the plus charges to the photosensitive drum 1 becomes smaller and the amount of movement of the toner T of minus charges to the transferring material P accompanying it also becomes smaller.

As the result, there has been the inconvenience that in the leading edge portion of the transferring material P of FIG. 7A to the portion thereof immediately before the interference of the pre-charging current becomes null, the transferred image becomes a dark image, but in the portion of the transferring material P of FIG. 7B from immediately after the interference of the pre-charging current has become null to the trailing edge portion, the transferred image becomes a faint image.

So, description will now be made of an embodiment in which even when the transferring material is of a length astride the charging means and the transferring means, the influence of a change in the current flowing from the charging means to the image bearing body through the transferring material upon transfer is eliminated to thereby obtain a uniform image of a high quality free of density unevenness.

The construction of the apparatus of the present embodiment is similar to that of FIG. 1. In the present embodiment, design is made such that at least transferring material of the maximum size is astride the charging means and the transferring means.

When a strong before-transfer charging bias voltage (pre-charging bias voltage) is applied with the surface resistance reduced like OHT under H/H environment, the interference of the before-transfer charging bias voltage with the transferring bias voltage occurs. This interference is the phenomenon that when the transferring material is in contact with both of the charging roller 26 and the transferring blade 4Y, much current flows to the photosensitive drum 1Y as compared with a case where the transferring material has left the charging roller 26. Accordingly, it is necessary to control the transferring bias voltage so that even after the transferring material has left the charging roller 26, the same transferring current as thitherto may flow.

So, in the present embodiment, in order to eliminate the influence of the change in the current flowing from the charging roller 26 to the photosensitive drum 1Y through the transferring material upon transfer before and after the transferring material leaves the charging roller 26, the amount of shift of the transferring bias voltage was calculated in advance on the basis of the resistance information of the transferring material detected by the first detecting means 33A, and the transferring bias voltage was changed in accordance with the timing at which the transferring material leaves the charging roller 26.

To know the timing at which the transferring material leaves the charging roller 26, it can be calculated from the size of the transferring material. In the present embodiment, the timing at which the trailing edge portion of the transferring material leaves the charging roller 26 was calculated on the basis of paper size information the user set by a printer controller, and the transferring bias voltage was shifted.

Mentioning a specific example in the present embodiment, when an OHT sheet of A4 size was used under H/H environment, the following setting was adopted:

Before-transfer charging bias voltage: 1.5 kV

First color transferring bias voltage: −0.5 kV

First color transferring bias voltage after the transferring material has left the before-transfer charging roller: +0.5 kV When as described above, the first color transferring bias voltage was strengthened at the timing whereat the trailing edge portion of the transferring material left the charging roller 26, the density unevenness before and after the transferring material left the charging roller 26 could be eliminated.

In the above-described example, the amount of shift of the transferring bias voltage was $\Delta V=0.5-(-0.5)=1$ kV, but this amount of shift differs depending on the resistance value and environment of the transferring material and therefore, the transferring bias voltage can be determined, for example, from the current value of the before-transfer charging bias voltage, and further on the basis of that value, the amount of shift of the transferring bias voltage can be found by calculation.

Another embodiment of the present invention will now be described.

In the aforedescribed embodiment, the timing was determined on the basis of the paper size information of the transferring material and the transferring bias voltage was changed, but if the change in the transferring bias voltage is sudden, density unevenness may occur on the image before and after the changeover of the transferring bias voltage. In the present embodiment, in order to prevent this, design is made such that the transferring bias voltage is gently controlled.

Figure 8:
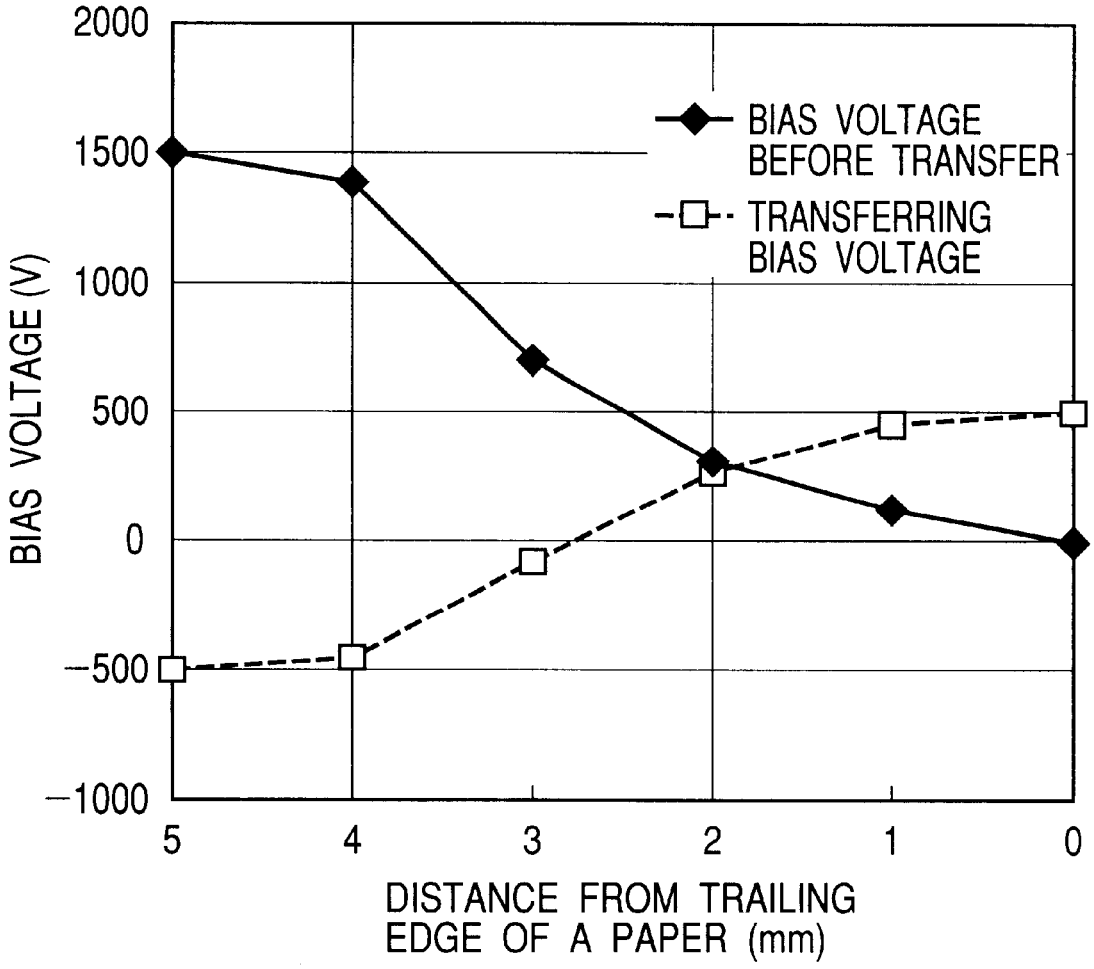
FIG. 8 is a graph illustrating an example of bias voltage control in another embodiment of the present invention.

Specifically, as shown in the graph of FIG. 8, at a point of time whereat the non-image portion of the trailing edge of the transferring material which is 5 mm before the trailing edge portion of the transferring material leaves the charging roller 26 has come to the charging roller 26, the before-transfer charging bias voltage (pre-charging bias voltage) begins to be controlled in a direction to be gradually weakened, and in operative association therewith, the transferring bias voltage begins to be controlled in a direction to be gradually strengthened. This control is effected until the trailing edge of the transferring material leaves the charging roller 26, and the interference of the before-transfer charging bias voltage is gradually erased while the amount of current flowing into the photosensitive drum 1Y is maintained constant, and at a point of time whereat the trailing edge portion of the transferring material has left the charging roller 26, the before-transfer charging bias voltage is rendered into 0V, thus completing the control.

By this control, the amount of pre-charging of the transferring material by the before-transfer charging is weakened in the non-image portion of the trailing edge of the transferring material, but this occurs in the non-image portion and therefore poses no problem in terms of the image.

On the other hand, the changeover of the transferring bias voltage is effected at a distance between the charging roller 24 and the first transferring station inside (upstream side) from the trailing edge of the image, and is executed apparently in a portion on the image. However, the current flowing into the photosensitive drum 1Y is kept constant by the above-described control and therefore, the amount of toner charges, i.e., the amount of toner, transferred to the transferring material is kept constant, and density unevenness does not occur on the image.

By the before-transfer charging bias voltage and the transferring bias voltage being controlled as described above, the interference of the before-transfer charging bias voltage becomes null, and the possibility of a boundary line appearing in the image becomes null. Also, a width of 5 mm is given to fluctuate the bias voltage and therefore, there is not the possibility that overshooting is caused by the sudden fluctuation of the bias power supply and the disturbance of the image occurs.

The present embodiment is characterized in that in a multicolor image forming apparatus of the in-line type similar to the aforedescribed embodiment, design is made such that the before-transfer charging current (pre-charging current) is monitored and the timing at which the before-transfer charging bias voltage no longer flows to the photosensitive drum 1Y, that is, the interference becomes null, is detected, and the transferring bias voltage is actively controlled.

When the before-transfer charging voltage is constant-voltage-controlled and the current supplied from the before-transfer charging power supply 27A is monitored, a current purely charging the transferring material is detected until the leading edge portion of the transferring material comes into contact with the photosensitive drum 1Y. Thereafter, since the transferring material has begun to contact with the photosensitive drum, the current also flows into the photosensitive drum through the transferring material and therefore, more of the current from the before-transfer charging power supply is detected. When the transferring material further advances and the trailing edge portion thereof leaves the charging roller 26, the current flowing from the before-transfer charging power supply to the photosensitive drum becomes null and therefore, a change in the current from the before-transfer charging power supply is observed again. At the same time, the current flowing to the photosensitive drum decreases by an amount corresponding to the fact that the current from the before-transfer charging power supply becomes null.

Accordingly, if this timing is detected by the first detecting means 33A or 33Y and the transferring bias voltage is shifted as in the aforedescribed embodiment, any change in the density of the image can be prevented.

In the case of the present embodiment, even if the size of the transferring material the user has set in the printer controller does not coincide with the actual size value of the transferring material, the control of the transferring bias voltage at the optimum timing will become possible.

As described above, according to the present embodiment, the transferring bias voltage is made changeable at the timing whereat a transferring material having a length astride the charging means and the transferring means leaves the charging means and therefore, even in such a situation that a transferring material like OHT is used under high-temperature high-humidity environment and the interference of the current by the before-transfer charging bias voltage flowing through the transferring material occurs to the transferring current, the influence upon transfer resulting from a change in the current by the before-transfer charging before and after the transferring material leaves the charging means can be eliminated and a uniform image of a high quality free of density unevenness can be obtained.

While in any of the above-described embodiments, the results of the detection obtained by the first detecting means and the second detecting means are reflected in the setting of the before-transfer charging bias voltage (pre-charging bias voltage) and the transferring bias voltage, the present invention is not restricted thereto, but it is also possible to reflect these results of the detection in the setting of other process conditions, for example, various conditions such as the primary charging bias voltage of the photosensitive drum and the developing bias voltage of the developing device, or the process speed of the image forming apparatus and the fixing temperature of the fixing apparatus.

Also, while the detecting bias voltage is applied to the charging means and the transferring means during the supply of the transferring material to thereby detect the then current value, the detecting bias voltage may be applied during the non-supply of the transferring material such as during pre-rotation to thereby detect the then current value.

Also, while in the above-described embodiments, the before-transfer charging means serving as sucking charging means and pre-charging means is installed upstream of the transferring part of the first image forming station with respect to the conveying direction of the transferring material and the detection of the current and pre-charging are effected by the before-transfer charging means, the before-transfer charging means and the sucking charging means may be discretely installed from the upstream side, for example, on this side of the transferring part, and the detection of the current and pre-charging may be effected by the before-transfer charging means and the sucking charging means, respectively. Further, the sucking charging means may not be provided and the before-transfer charging means and the pre-charging means may be discretely provided from the upstream side on this side of the transferring part, and the detection of the current and pre-charging may be effected by the before-transfer charging means and the pre-charging means, respectively, and in this case, the portion effecting the detection of the current is not restricted to the blank portion on the leading edge of the transferring material, but it becomes possible to effect the detection of the current value with higher accuracy.

As the before-transfer charging means and the pre-charging means, use can be made of a suitable combination of conventional charging means such as a charging brush and a corona charger, besides the charging roller. Also, as the charging roller, use can be made of a member similar to a sucking roller or a sucking opposing roller.

Also, while description has been made with respect to a full color image forming apparatus of the tandem in-line type, the present invention is not restricted thereto, but can also be applied to a monochromatic image forming apparatus, and is also applicable to the secondary transfer or the like in an image forming apparatus using an intermediate transferring body.

Also, while the pre-charging means has been described with respect to a case where it applies a bias voltage of the same polarity as the transferring bias voltage from the surface side of the transferring material, the present invention is also applicable to a case where it applies a bias voltage of the opposite polarity to the transferring bias voltage from the back side of the transferring belt.

While the before-transfer charging power supply and the transferring power supply have both been described with the case of constant voltage control taken as an example, these boltage source may be constant-current-controlled. In this case, detecting bias voltages can be applied under constant current control from these power supplyers, and the then output voltages of the power supplyers can be detected by the first and second detecting means and the pre-charging bias voltage, the transferring bias voltage, etc. can be set, and likewise, the present invention can be applied to high-speed image formation and it becomes possible to obtain images of a high quality.

While the embodiments of the present invention have been described above, the present invention is not restricted to the above-described embodiments, but all modifications are possible within the scope of the present invention.

What is claimed is:

1. An image forming apparatus comprising:

an image bearing body bearing a toner image thereon;

transferring means for transferring the toner image on said image bearing body to a transferring material; and charging means for charging the transferring material by applying a voltage before a transfer by said transferring means, wherein the voltage applied to said charging means is controlled on the basis of a current produced when a leading edge portion of the transferring material is charged by said charging means.

2. An image forming apparatus according to claim 1, wherein an absolute value of the voltage applied to said charging means if the transferring material is a resin sheet is greater than if the transferring material is plain paper.

3. An image forming apparatus according to claim 1, further comprising a transferring material bearing body for bearing the transferring material thereon.

4. An image forming apparatus according to claim 3, wherein said charging means comprises sucking means for sucking the transferring material to said transferring material bearing body.

5. An image forming apparatus according to claim 1, wherein said charging means charges the transferring material to a polarity opposite to a regular charging polarity of the toner.

6. An image forming apparatus comprising:

an image bearing body bearing a toner image thereon;

transferring means for transferring the toner image on said image bearing body to a transferring material by applying a voltage in a transferring part;

charging means for charging the transferring material before a transfer by said transferring means; and detecting means for detecting a current produced when a voltage is applied to said charging means, wherein the voltage applied to said transferring means when an image-formed portion of the transferring material passes said transferring part is controlled on the basis of a current produced by a predetermined voltage being applied to said transferring means when a leading edge portion of the transferring material passes said transferring part, and the predetermined voltage is controlled on the basis of the output from said detecting means.

7. An image forming apparatus according to claim 6, wherein the leading edge portion is a non-image-formed area.

8. An image forming apparatus according to claim 6, wherein said detecting means detects currents produced when a plurality of voltages of different values are applied to said charging means.

9. An image forming apparatus according to claim 6, wherein said detecting means detects a current produced when the leading edge portion is charged by said charging means.

10. An image forming apparatus according to claim 6, further comprising a transferring material bearing body bearing the transferring material thereon.

11. An image forming apparatus according to claim 10, wherein said charging means comprises sucking means for sucking the transferring material to said transferring material bearing body.

12. An image forming apparatus comprising:

an image bearing body bearing a toner image thereon;

transferring means for transferring the toner image on said image bearing body to a transfer material by applying a voltage in a transferring part;

charging means for charging the transferring material before a transfer by said transferring means; and detecting means for detecting a voltage produced when a current is applied to said charging means, wherein the voltage applied to said transferring means when an image-formed portion of the transferring material passes said transferring part is controlled on the basis of a current produced by a predetermined voltage being applied to said transferring means when a leading edge portion of the transferring material passes said transferring part, and the predetermined voltage is controlled on the basis of an output from said detecting means.

13. An image forming apparatus according to claim 12, wherein the leading edge portion is a non-image-formed area.

14. An image forming apparatus according to claim 12, wherein said detecting means detects voltages produced when a plurality of currents of different values are applied to said charging means.

15. An image forming apparatus according to claim 12, wherein said detecting means detects a voltage produced when the leading edge portion is charged by said charging means.

16. An image forming apparatus according to claim 12, further comprising a transferring material bearing body for bearing the transferring material thereon.

17. An image forming apparatus according to claim 16, wherein said charging means comprises sucking means for sucking the transferring material to said transferring material bearing body.

18. An image forming apparatus comprising:

an image bearing body bearing a toner image thereon;

a transferring material bearing body bearing a transferring material thereon;

transferring means for transferring the toner image on said image bearing body to the transferring material borne on said transferring material bearing body;

charging means having a voltage for charging the transferring material borne on said transferring material bearing body by applying a voltage in a charging part before a transfer by said transferring means; and detecting means for detecting a current produced when a voltage is applied to said transferring material bearing body on which the transferring material is not borne, wherein the voltage applied to said charging means when the transferring material passes said charging means is controlled on the basis of an output from said detecting means.

19. An image forming apparatus according to claim 18, wherein said charging means comprises sucking means for sucking the transferring material to said transferring material bearing body.

20. An image forming apparatus according to claim 18, wherein the voltage applied to said charging means when a leading edge portion of the transferring material passes said charging part is controlled on the basis of the output from said detecting means.

21. An image forming apparatus according to claim 18, wherein said detecting means detects currents produced when a plurality of voltages of different values are applied to said transferring material bearing body.

22. An image forming apparatus according to claim 18, wherein the voltage applied to said charging means when an image-formed portion of the transferring material passes said charging part is controlled on the basis of a current produced by the voltage being applied to said charging means when a leading edge portion of the transferring material passes said charging part.

23. An image forming apparatus comprising:

an image bearing body bearing a toner image thereon;

a transferring material bearing body bearing a transferring material thereon;

transferring means for transferring the toner image on said image bearing body to the transferring material borne on said transferring material bearing body;

charging means for charging the transferring material borne on said transferring material bearing body by applying a voltage in a charging part before a transfer by said transferring means; and detecting means for detecting a voltage produced when a current is applied to said transferring material bearing body on which said transferring material is not borne, wherein the voltage applied to said charging means when the transferring material passes said charging part is controlled on the basis of an output from said detecting means.

24. An image forming apparatus according to claim 23, wherein said charging means comprises sucking means for sucking the transferring material to said transferring material bearing body.

25. An image forming apparatus according to claim 23, wherein the voltage applied to said charging means when a leading edge portion of the transferring material passes said charging part is controlled on the basis of the output from said detecting means.

26. An image forming apparatus according to claim 23, wherein said detecting means detects voltages produced when a plurality of currents of different values are applied to said transferring material bearing body.

27. An image forming apparatus according to claim 23, wherein the voltage applied to said charging means when an image-formed portion of the transferring material passes said charging part is controlled on the basis of a current produced by the voltage being applied to said charging means when a leading edge portion of the transferring material passes said charging part.

28. An image forming apparatus comprising:

an image bearing body bearing a toner image thereon;

transferring means, by applying a voltage, for transferring the toner image on said image bearing body to a transferring material being conveyed in a transferring part; and charging means for charging the transferring material by applying a voltage in a charging part before a transfer by said transferring means, wherein when in the conveying direction of the transferring material, a length of the transferring material is greater than a distance from said charging part to said transferring part, the voltage applied to said transferring means is changed over at timing whereat a trailing edge portion of the transferring material passes said charging part.

29. An image forming apparatus according to claim 28, wherein the voltage applied to said transferring means after the trailing edge portion has passed said charging part is greater than the voltage before the transferring material passes said charging part.

30. An image forming apparatus according to claim 28, wherein the trailing edge portion has a predetermined area, and the voltage applied to said transferring means is gradually made greater while the predetermined area passes said charging part.

31. An image forming apparatus according to claim 30, wherein the voltage applied to said charging means is gradually made smaller while the predetermined area passes said charging part.

32. An image forming apparatus according to claim 30, wherein the predetermined area is a non-image-formed area.

33. An image forming apparatus according to claim 28, further comprising a transferring material bearing body for bearing the transferring material thereon.

34. An image forming apparatus according to claim 33, wherein said charging means comprises sucking means for sucking the transferring material to said transferring material bearing body.

* * * * *